US011161024B1

(12) United States Patent
Hochberg

(10) Patent No.: US 11,161,024 B1
(45) Date of Patent: Nov. 2, 2021

(54) COLLAPSIBLE, WEIGHTED TEE BALL STAND

(71) Applicant: Seth Hochberg, Walpole, MA (US)

(72) Inventor: Seth Hochberg, Walpole, MA (US)

(73) Assignee: FRANKLIN SPORTS, INC., Stoughton, MA (US)

( * ) Notice: Subject to any disclaimer, the term of this patent is extended or adjusted under 35 U.S.C. 154(b) by 368 days.

(21) Appl. No.: 15/235,331

(22) Filed: Aug. 12, 2016

(51) Int. Cl.
*A63B 69/00* (2006.01)

(52) U.S. Cl.
CPC ..... *A63B 69/0075* (2013.01); *A63B 69/0002* (2013.01); *A63B 2069/0008* (2013.01); *A63B 2210/50* (2013.01)

(58) Field of Classification Search
CPC ..... A63B 69/00; A63B 69/36
USPC ..... 473/257, 417, 430
See application file for complete search history.

(56) References Cited

U.S. PATENT DOCUMENTS 2,884,250 A 4/1959 Patterson
4,173,340 A * 11/1979 Kanno ..... A63B 69/0091 473/575
4,227,691 A 10/1980 Lefebvre et al.
4,383,686 A 5/1983 Cardieri
4,445,685 A 5/1984 Cardieri
4,664,374 A 5/1987 Groves
4,709,924 A 12/1987 Wilson et al.
4,819,937 A 4/1989 Gordon
4,886,267 A 12/1989 Licciardi et al.
4,938,478 A * 7/1990 Lay ..... A63B 69/0091 473/423
4,962,924 A 10/1990 James
5,004,234 A 4/1991 Hollis
5,100,134 A 3/1992 Becker
5,388,823 A 2/1995 Prieto
D373,806 S 9/1996 Bunnell
5,897,444 A 4/1999 Hellyer
D410,052 S 5/1999 Davis et al.
5,916,045 A 6/1999 Busch
6,099,418 A 8/2000 Owen
6,238,307 B1 5/2001 Owen
6,358,163 B1 3/2002 Tanner
6,413,175 B1 7/2002 Mooney, Jr.
6,884,185 B2 4/2005 Udwin et al.
D514,638 S 2/2006 deGrasse
7,063,632 B2 6/2006 Green
7,226,372 B2 6/2007 Flanigan
7,281,998 B2 10/2007 Tanner
7,354,360 B1 4/2008 Eckstein
7,479,074 B1 1/2009 Pierce
7,578,748 B2 * 8/2009 Evans ..... A63B 69/3676 473/257
7,641,573 B2 1/2010 Cech
7,662,052 B1 2/2010 Vidrine
7,704,168 B1 * 4/2010 Hochberg ..... A63B 69/0002 473/417

(Continued)

*Primary Examiner* — Eugene L Kim
*Assistant Examiner* — Christopher Glenn
(74) *Attorney, Agent, or Firm* — Joseph B Bowman

(57) ABSTRACT

A tee ball stand with a ball holder fitted to a two-piece adjustable stanchion received by a flex sleeve supported from a base hub. Weighted legs formed from hexagonal tubing are fitted at right angles into hex sockets of the base hub to prevent twisting. The outer ends of the legs are closed with an end cap having a ground engaging spur to resist sliding on the ground.

10 Claims, 5 Drawing Sheets

(56) References Cited

U.S. PATENT DOCUMENTS

| | | | | |
|---|---|---|---|---|
| 7,744,496 | B2 | 6/2010 | Chisena | |
| D633,583 | S | 3/2011 | Guevara | |
| 8,162,780 | B2 | 4/2012 | Wang | |
| 8,257,202 | B1 | 9/2012 | Stanek | |
| 8,597,143 | B2 | 12/2013 | Newman | |
| 8,734,274 | B1 | 5/2014 | Hochberg | |
| 8,992,348 | B2 | 3/2015 | Meier et al. | |
| 2003/0224880 | A1* | 12/2003 | Hansberry | A63B 69/0002 473/430 |
| 2006/0019773 | A1 | 1/2006 | Newman | |
| 2006/0205540 | A1 | 9/2006 | Liu | |
| 2009/0082140 | A1 | 3/2009 | Liao | |
| 2010/0016100 | A1* | 1/2010 | Liu | A63B 69/0002 473/417 |
| 2010/0056306 | A1 | 3/2010 | Chen | |
| 2011/0281671 | A1 | 11/2011 | Chen | |
| 2012/0052986 | A1 | 3/2012 | Quinn | |
| 2012/0172153 | A1 | 7/2012 | Newman | |
| 2013/0178313 | A1 | 7/2013 | Meier et al. | |
| 2015/0231470 | A1* | 8/2015 | Kanner | A63B 69/0075 473/417 |

* cited by examiner

COLLAPSIBLE, WEIGHTED TEE BALL STAND

CROSS-REFERENCE TO RELATED APPLICATIONS

This application has no related applications.

STATEMENT REGARDING FEDERALLY SPONSORED RESEARCH OR DEVELOPMENT

The inventions described and claimed in this application were not made under federally sponsored research and development.

BACKGROUND OF THE INVENTION

This invention relates to a tee ball stand. More specifically, this invention relates to a tee ball stand which is fully collapsible for compact, lineal storage and which has a weighted base to resist tipping when inadvertently struck with a bat.

Tee ball stands are characteristically used in the process of teaching young children to hit a ball with a bat. The typical tee ball stand comprises a flat, ground engaging plate, most often in the shape of a baseball home plate, which supports an adjustable vertical pole having a ball support cup on the upper end. A ball is placed on the support cup so a youngster can then strike at the stationary ball by swinging a bat instead of the more difficult task of attempting to hit a moving ball. With limited experience or limited coordination, the youngster may occasionally strike the cup or pole holding the ball, rather than the ball itself. This can be expected as part of the learning process. As a result, however, the tee ball stand is frequently tipped over or moved and has to be repositioned for the training session to continue. This can be a source of frustration and discouragement, as well as a safety concern, for the youngster and coach in the event of inadvertent contact with errant bat swings.

U.S. Pat. Nos. 4,227,691, 4,709,924, 4,819,937, 4,962,924, 5,004,234, 5,916,045, 6,099,418 and 6,884,185, as well as others, are characteristic of various tee ball practice devices having a base plate that rests flat on the ground to support some type of ball holding apparatus.

Even though some of the prior art references disclose a telescopingly adjustable vertical pole, one can easily appreciate the problem of storing a tee ball stand with a large base plate when the equipment is not in use. My U.S. Pat. No. 8,734,274 offered some alternative solutions for storage by proposing an X-frame base that was either foldable alongside the vertical stanchion or disassembled. In either case, the overall length was not optimal for original merchandise packaging and the tee ball stand proved to be slightly unstable when struck with an errant bat.

Therefore, a need remains in the field of youth sports for a tee ball stand that can be easily and quickly assembled from a condition of compact lineal storage and that will be tip resistant when inadvertently struck with a bat. The primary objective of this invention is to meet these needs.

SUMMARY OF THE INVENTION

More specifically, an object of the invention is to provide a tee ball stand that will yield from an upright orientation in the event it is struck with an errant bat of a youngster so as to protect the user from experiencing the shock of impact, but, at the same time, the tee ball stand will remain in or return to a preselected location on the ground.

Another object of the invention is to provide a tee ball stand with an upright stanchion including a flex connection with the base to readily deflect when the stanchion is struck by an errant blow of a bat and then return to an upright position.

A corollary object of the invention is to provide a tee ball stand of the character described including a weighted base to assist in combination with the flex connection to resist tipping of the tee ball stand when struck by an errant bat swing.

Another object of the invention is to provide a tee ball stand of the character described wherein the upright stanchion is telescopically adjustable to accommodate youngsters of varying heights.

A further object of the invention is to provide a tee ball stand easily assembled or disassembled without tools for minimal lineal packaging or storage.

Yet another object of the invention is to provide a tee ball stand for minimal lineal packaging or storage wherein the component parts are removably interconnected by friction fit.

In summary, an object of the invention is to provide a tee ball stand with a ball holder fitted to a two-piece adjustable stanchion received by a flex sleeve supported from a base hub. Weighted legs formed from hexagonal tubing are fitted at right angles into hex sockets of the base hub to prevent twisting. The outer ends of the legs are closed with an end cap having a ground engaging spur to resist sliding on the ground.

Other and further objects of the invention, together with the features of novelty appurtenant thereto, will appear in the course of the detailed description of the drawings.

BRIEF DESCRIPTION OF THE DRAWINGS

In the following description of the drawings, in which like reference numerals are employed to indicate like parts in the various views:

FIG. 5 is a side sectional view of a base leg of the tee ball stand as weighted with sand, gravel, or the like.

DETAILED DESCRIPTION OF THE DRAWINGS

Figure 1:
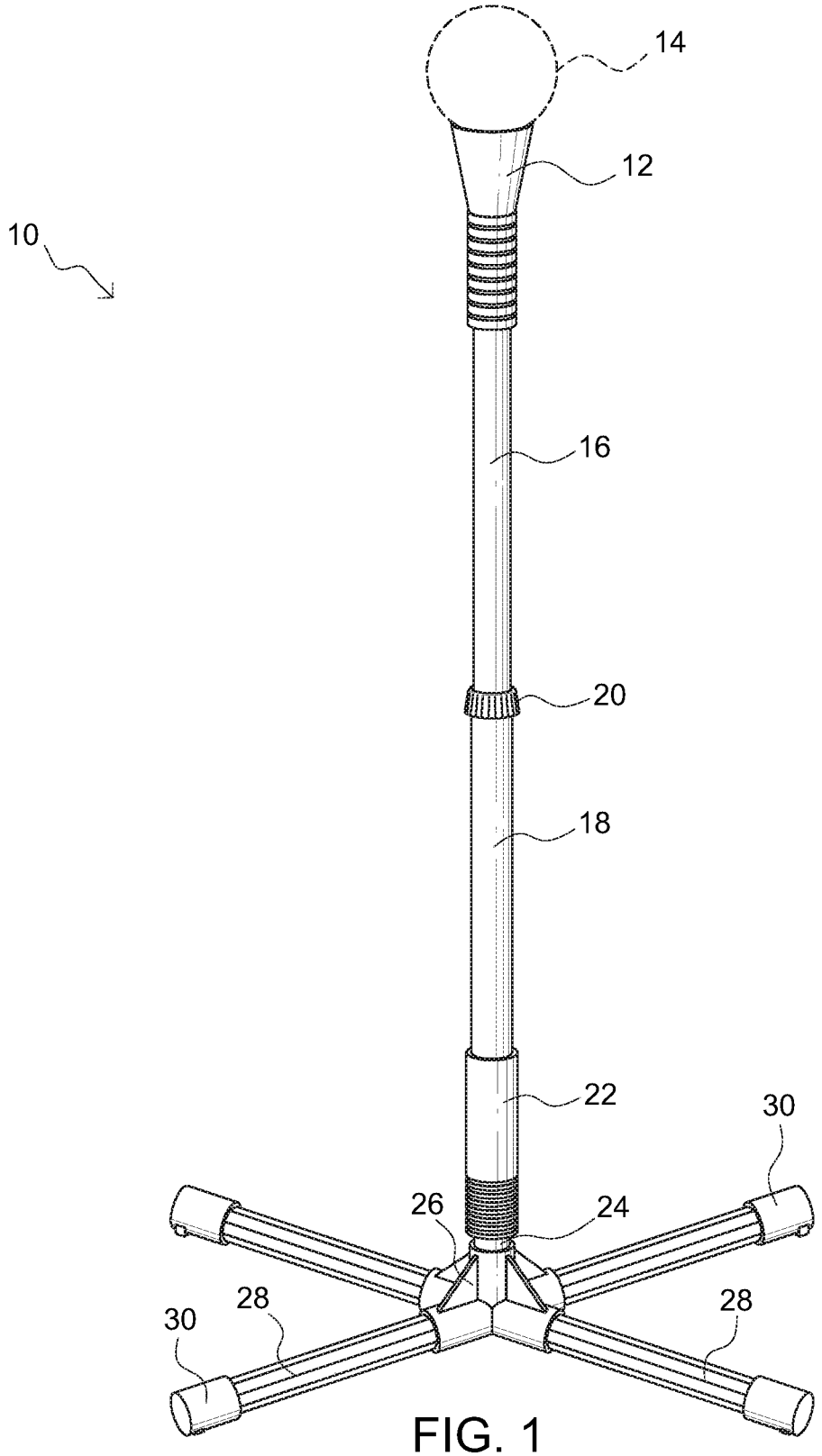
FIG. 1 is a perspective view of a tee ball stand constructed in accordance with a preferred embodiment of the invention.
Figure 2:
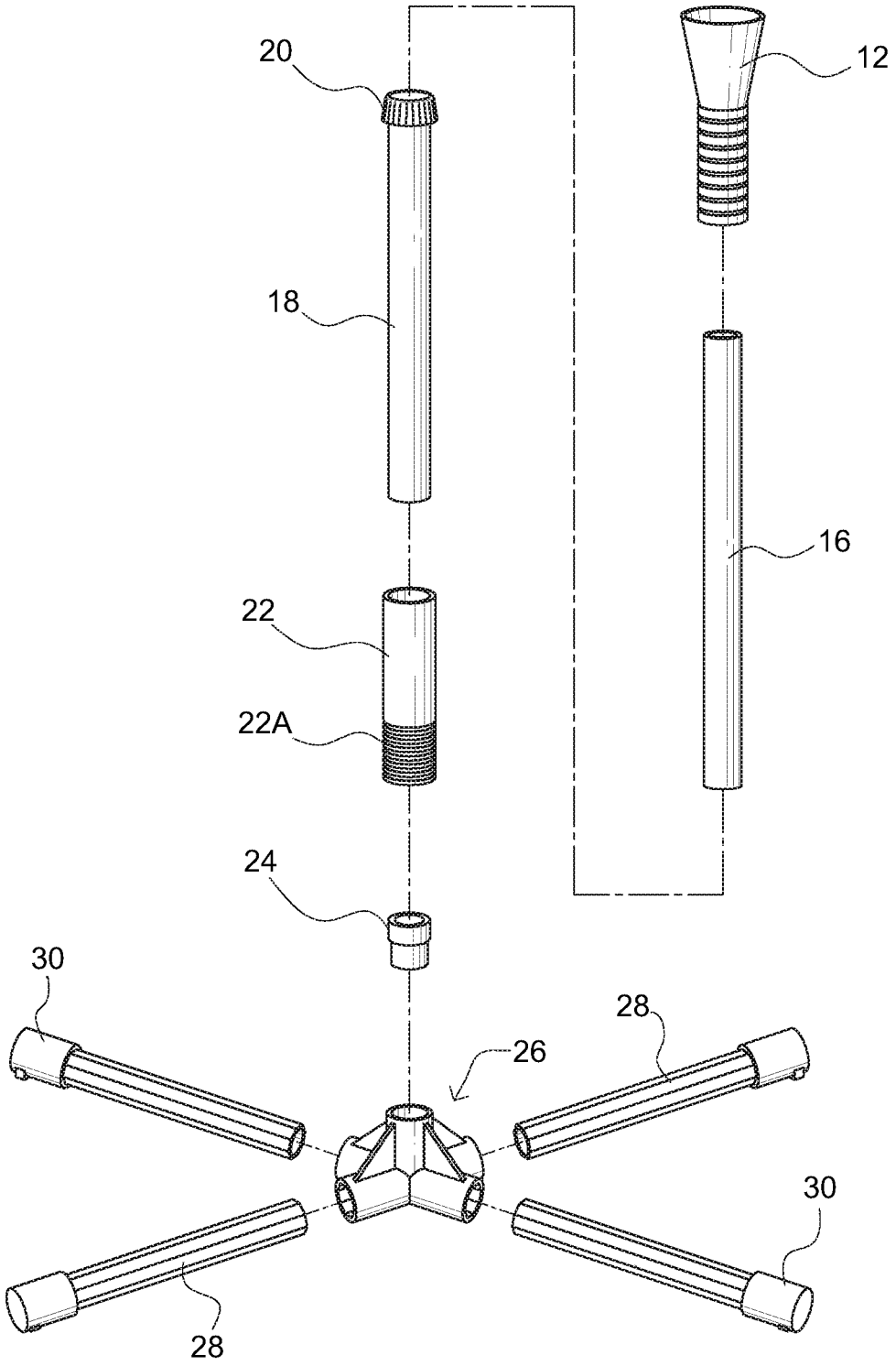
FIG. 2 is an exploded view of the tee ball stand shown in FIG. 1 to illustrate the component parts of the assembly.

Referring to the drawings in greater detail, the tee ball stand 10 includes a conical ball holder 12 adapted to support a ball 14 such as a baseball, softball, or similarly sized training ball. The ball holder 12 is removably installed by friction fit on the end of telescoping, upper stanchion tube 16. Tube 16 is cylindrical and sized with an outside diameter to slidably fit within the inside diameter of the cylindrical, lower stanchion tube 18. The overall height of the stanchion tubes 16 & 18 can be adjustably fixed by tightening the locking nut 20 on the uppermost end of the lower stanchion tube 18 in a manner commonly used in tee ball stands previously known in this art.

Figure 3:
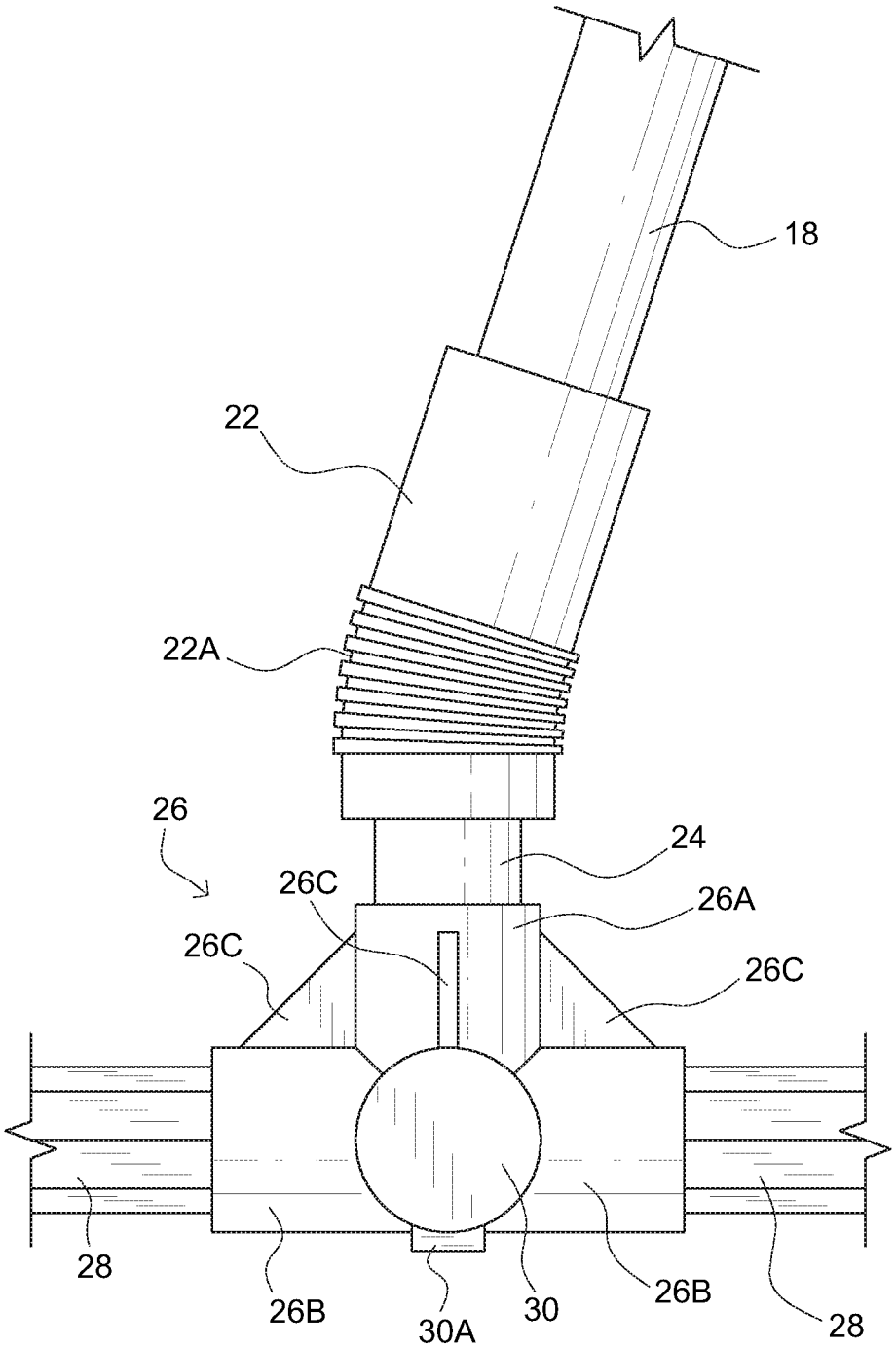
FIG. 3 is an enlarged side elevational view of the base hub fitted with a flex sleeve and showing fragmentary views of the base legs and stanchion with the flex sleeve slightly tilted as if hit by an errant bat swing.

The lower stanchion tube 18 is removably installed by friction fit to a flex sleeve 22 having a corrugated portion 22*a* to permit slight flexure as shown in FIG. 3 when the ball holder 12, or stanchion tubes 16 or 18 are inadvertently struck with a bat. The flex sleeve 22, in turn, is removably installed by friction fit to a transition fitting 24 which may be a separate piece as illustrated or part of the base hub 26.

Figure 4:
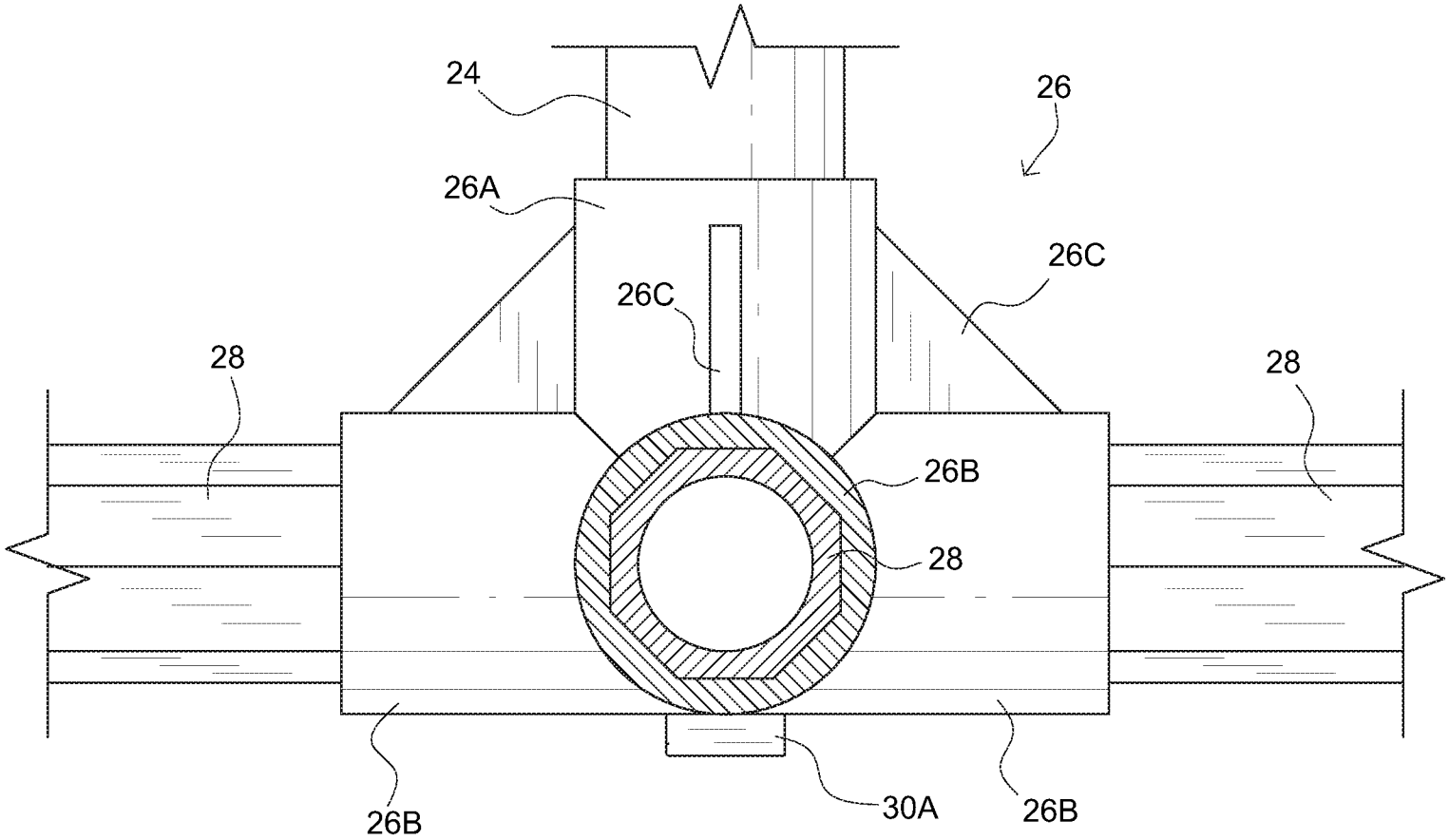
FIG. 4 is an enlarged side elevational view of the base hub similar to FIG. 3 but showing the middle base leg and middle hub socket in section to illustrate the interconnection of these parts.

The base hub 26 has an upright socket 26*a* which receives the transition fitting 24 by friction fit or permanently joined thereto. The base hub 26 also includes four horizontal sockets 26*b* arranged at right angles to each other. Braces 26*c* are joined between the upright socket 26*a* and the horizontal sockets 26*b*. Interiorly, the horizontal sockets 26*b* are hexagonal in cross sectional shape as shown in FIG. 4.

Each horizontal socket 26*b* of the base hub 26 removably receives by friction fit a base leg 28. The base legs 28 are hexagonal in cross sectional shape (see FIG. 4) so as to prevent twisting or rotation when installed in the socket 26*b* of hub 26.

Figure 5:
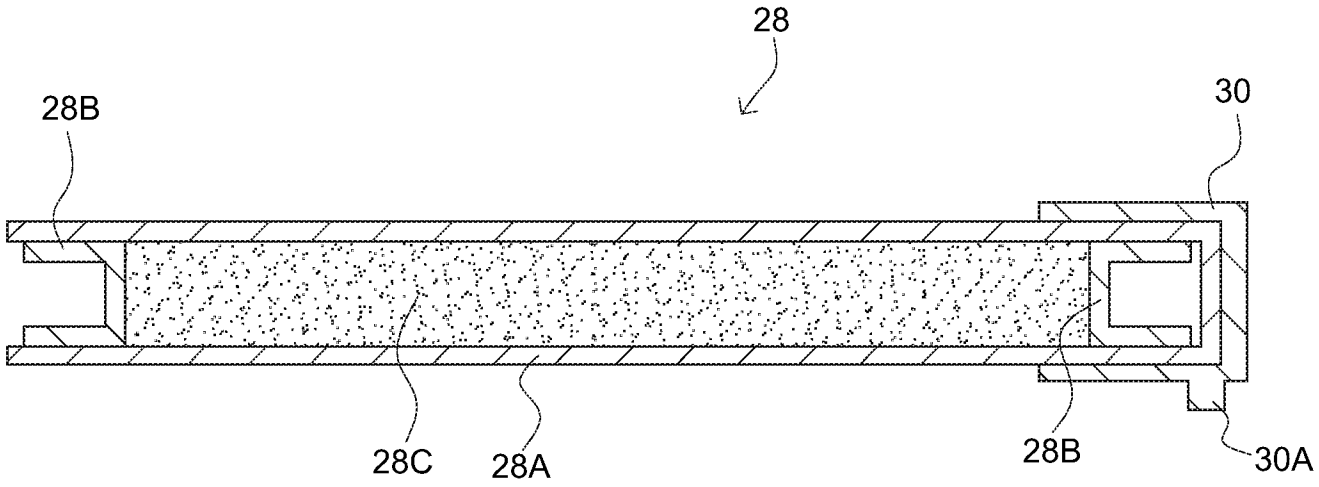

As shown in FIG. 5, each leg 28 includes a hexagonal tube 28*a* closed at each end with a plug 28*b*. Weighting material 28*c*, such as sand, gravel, lead shot, or the like, fills the interior of the tube 28*a* between the end plugs 28*b*.

The outer end of each leg 28 is fitted with an end cap 30 having a ground engaging spur 30*a* which registers with one of the flat hexagonal surfaces of the leg 28. It is intended that the leg 28 be inserted into a socket 26*b* of the hub 26 such that the spur 30*a* of the end cap 30 is oriented downwardly to engage the ground when the tee ball stand 10 is fully assembled. This prevents the tee ball stand 10 from sliding along the ground.

The tubular parts of the tee ball stand 10—namely, upper stanchion tube 16, lower stanchion tube 18, and base legs 28—are all of comparable lengths. When disassembled, either for original merchandise packaging or for storage, this permits extremely compact positioning of the component parts. Assembly of the components is easily accomplished since all may be friction fitted together by hand without the need for installation tools. Disassembly is equally easy by simply reversing the assembly process and pulling the components apart for separation and storage.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A tee ball stand to be supported on the ground when in use, said tee ball stand comprising:

an upright, elongate stanchion having upper and lower ends and comprising two tubular sections adjustably telescoping together with a locking nut on one of said tubular sections to secure said tubular sections at a preselected length and, when in use, said stanchion having an intended orientation substantially perpendicular to said ground, a ball supporting member removably installed by friction fit on the upper end of said stanchion;

a flexible sleeve connection removably installed by friction fit on the lower end of said stanchion and having a portion thereof adapted to arcuately flex with respect to said stanchion;

a base hub having an upright stub on which said flexible sleeve connection is removably installed by friction fit, and having a plurality of horizontally oriented sockets beneath said upright stub; and a plurality of support legs removably installed by friction fit in said horizontally oriented sockets of said base hub;

wherein said stanchion, ball supporting member, flexible sleeve connection, base hub, and support legs can be readily disassembled by hand without the aid of a tool and positioned for extremely compact storage.

2. The tee ball stand as in claim 1, wherein each support leg comprises a hollow tube filled with weighting material and being sealed at both ends.

3. The tee ball stand as in claim 2 including a plurality of end caps attached to the ends of said support legs with each said end cap having a downwardly oriented ground engaging spur in order to resist sliding of said tee ball stand on the ground.

4. The tee ball stand as in claim 1, wherein each support leg comprises a hollow tube shaped as a regular polygon in cross section, and each said horizontally oriented socket of said base hub is interiorly shaped as a regular polygon complementary to said regular polygon shape of said support leg whereby each said support leg may be removably installed by friction fit into a horizontally oriented socket of said base hub so as to prevent rotation or twisting of said support leg with respect to said horizontally oriented socket.

5. The tee ball stand as in claim 4, wherein each support leg comprises a hollow tube filled with weighting material and being sealed at both ends.

6. The tee ball stand as in claim 5 including a plurality of end caps attached to the ends of said support legs with each said end cap having a downwardly oriented ground engaging spur aligned to register with a flat surface of the regular polygon shape of said hollow tube to thereby resist sliding of said tee ball stand on the ground.

7. The tee ball stand as in claim 4, wherein each support leg comprises a hollow tube shaped as a regular hexagon in cross section, and each said horizontally oriented socket of said base hub is interiorly shaped as a regular hexagon complementary to said regular hexagon shape of said support leg whereby each said support leg may be removably installed by friction fit into a horizontally oriented socket of said base hub so as to prevent rotation or twisting of said support leg with respect to said horizontally oriented socket.

8. The tee ball stand as in claim 7, wherein each support leg comprises a hollow tube filled with weighting material and being sealed at both ends.

9. The tee ball stand as in claim 8 including a plurality of end caps attached to the ends of said support legs with each said end cap having a downwardly oriented ground engaging spur aligned to register with a flat surface of the regular hexagon shape of said hollow tube to thereby resist sliding of said tee ball stand on the ground.

10. The tee ball stand as in claim 1 wherein said base hub has four horizontally oriented sockets arranged at right angles to each other.

* * * * *